US008936242B1

(12) United States Patent
Ferrara et al.

(10) Patent No.: US 8,936,242 B1
(45) Date of Patent: Jan. 20, 2015

(54) RE-TIME SHEET BUFFERING SYSTEM FOR DIGITAL PRINT FINISHERS

(71) Applicant: Xerox Corporation, Norwalk, CT (US)

(72) Inventors: Joseph M. Ferrara, Webster, NY (US); Joseph J. Ferrara, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/943,897

(22) Filed: Jul. 17, 2013

(51) Int. Cl.
*B65H 29/68* (2006.01)
*B65H 39/00* (2006.01)

(52) U.S. Cl.
CPC ..... *B65H 39/00* (2013.01)
USPC ..... 271/266; 271/270

(58) Field of Classification Search
CPC ..... B65H 39/10; B65H 29/68
USPC ..... 271/266, 270; 270/58.01
See application file for complete search history.

(56) References Cited

U.S. PATENT DOCUMENTS 8,511,665 B2 * 8/2013 Iwata et al. ..... 270/58.31
8,528,898 B2 * 9/2013 Kushida ..... 271/225
2008/0317530 A1 * 12/2008 Taki et al. ..... 399/367

* cited by examiner

*Primary Examiner* — Michael McCullough
(74) *Attorney, Agent, or Firm* — Hoffmann & Baron, LLP

(57) ABSTRACT

A re-time sheet buffering system is used in connection with a finisher for a digital printing system and a plurality of media sheets arranged in sets. A path loop between a sheet path entrance and exit provides space for buffering. A registration nip decelerates, registers and accelerates sheets 1 through N. A first retime nip holds sheets 1 and 2 of the set at registration speed for a longer time than remaining sheets, to gain time for finishing, and then accelerates sheets 1 and 2. A second retime nip accelerates sheets 1 and 2 of the set to compiling speed. Sheets are transported, compiled, stapled, and ejected.

20 Claims, 4 Drawing Sheets

RE-TIME SHEET BUFFERING SYSTEM FOR DIGITAL PRINT FINISHERS

INCORPORATION BY REFERENCE

U.S. Pat. No. 7,422,210, filed on Mar. 4, 2005, entitled, "Sheet Deskewing System With Final Correction From Trail Edge Sensing," and assigned to the assignee hereof is incorporated in its entirety for the teachings therein.

TECHNICAL FIELD

This invention relates to buffering sheets in digital printing machines, and, more particularly, to an apparatus, system, and method for enabling increased productivity in a digital printing machine by varying the time interval of selected sheets in a finisher.

BACKGROUND

Digital printing machines can take on a variety of configurations. One common process is that of electrostatographic printing, which is carried out by exposing a light image of an original document to a uniformly charged photoreceptive member to discharge selected areas. A charged developing material is deposited to develop a visible image. The developing material is transferred to a medium sheet (paper) and heat fixed.

Another common process is that of direct to paper ink jet printing systems. In ink jet printing, tiny droplets of ink are sprayed onto the paper in a controlled manner to form the image. Other processes are well known to those skilled in the art.

The primary output product for a typical digital printing system is a printed copy substrate such as a sheet of paper bearing printed information in a specified format. Quite often, customer requirements necessitate that this output product be configured in various specialized arrangements ranging from stacks of collated loose printed sheets, to brief reports stapled together, to tabulated and bound booklets. The sheets of media, usually paper, are compiled, stapled, and ejected at the last stage of the job, in a region called a finisher.

Various external output devices have been designed for connection to a digital printing machine. The paper will exit the printing system and be passed to an external finishing device, wherein a critical parameter in such delivery is the capability to operate at process speed so as to not inhibit the function of the printing machine.

Finishing procedures, such as sorting, collating, stapling and ejecting, require the movement of mechanical components. In state-of-the-art digital printing machines, it is common to have a quantity of sets in a job stream which require various sorts of finishing activities. In order to accommodate multiple sets, each set in the stream is typically held or delayed until the finishing activity of the preceding set has been completed. Moreover, it is often necessary to slow the output speed of the printing machine so as not to exceed the rate at which the external device, or finisher, can receive and process sets of output documents for producing the final output product. These finishing delay times detract from the overall productivity of the printing system.

Sheet buffering can be defined as holding sheets of paper within a finisher paper path while functions like compiling, stapling, and ejecting sets are accomplished. One type of finisher will skip a sheet in between each set in order to free up time to accomplish these functions. The problem with this method is that it slows productivity. Another finisher uses a system that compiles three sets at a time to buffer. A three tray set compiling unit fills as sheets enter the finisher. They are unloaded by an expensive clamping system that brings sets to the stapler. The problem with this system is excessive hardware and associated cost. Still another finisher uses buffering arms to temporarily hold sheets and then drop them into a compiler. The apparatus is costly, and further problems arise with registration issues and timing constraints which limit the use of this system. Yet another finisher uses a wait station to buffer a sheet. However, with higher speed finishing devices, this type of buffering does not work. An example of such a high speed finishing device is a newly introduced production finisher which operates at 157 ppm production rate.

An example of a sheet buffering system can be found in U.S. Pat. No. 5,303,017, filed on May 7, 1993, entitled, "Print Skip Avoidance For On-Line Compiling," and assigned to the assignee hereof. An example of a sheet timing system can be found in U.S. Pat. No. 7,706,704, filed on Jun. 12, 2006, entitled, "Digital Printing Apparatus Having Substantially Equal Output Rates For Various Sheet Sizes And Orientations," and assigned to the assignee hereof. An example of a sheet registration system can be found in U.S. Pat. No. 8,109,506, filed on May 29, 2009, entitled, "Sheet Observer With A Limited Number Of Sheet Sensors," and assigned to the assignee hereof.

Accordingly, there is a need to provide a sheet buffering system that will vary the time interval of selected sheets in a finisher to allow finishing of a set.

There is a further need to provide a sheet buffering system of the type described and that not slow down the production rate of the printer.

There is a yet further need to provide a sheet buffering system of the type described and that is mechanically simple and robust, thereby minimizing cost and avoiding the problems associated with the prior art.

SUMMARY

In one aspect, a re-time sheet buffering system is used in connection with a finisher for a digital printing system and a plurality of media sheets arranged in sets. Each set includes sheets 1, 2, 3 through N. The re-time sheet buffer comprises a sheet path having a sheet path entrance to input the sheets at an input speed. A sheet path exit outputs the sheets. A path loop between the sheet path entrance and the sheet path exit provides space for buffering. A compiler area is located between the path loop and the sheet path exit. A compiler compiles sheet sets at a compiler speed in the compiler area.

A registration nip is disposed on the sheet path for decelerating sheets 1 through N from the input speed to a registration speed. The registration nip also performs registering and accelerating selected sheets.

A first retime nip is disposed on the sheet path downstream of the registration nip. The first retime nip is for holding sheets 1 and 2 of the set at a predetermined speed and for accelerating sheets 1 and 2 of the set.

A second retime nip is disposed on the sheet path downstream of the first retime nip and before the compiler area. The second retime nip is for accelerating sheets 1 and 2 of the set to compiling speed.

A plurality of sensors is arrayed on the sheet path for sensing the position and speed of the sheets, wherein sheets 1 and 2 of the set are held at registration speed for a longer time than remaining sheets, so as to gain time for finishing.

In another aspect, a re-time sheet buffering system is used in connection with a finisher for a digital printing system and a plurality of media sheets arranged in sets. Each set includes sheets 1, 2, 3 through N. The re-time sheet buffer comprises a sheet path having a sheet path entrance to input the sheets at an input speed. A sheet path exit outputs the sheets. A path loop between the sheet path entrance and the sheet path exit provides space for buffering. A compiler area is located between the path loop and the sheet path exit. A compiler compiles sheet sets at a compiler speed in the compiler area.

A transport apparatus is disposed adjacent the compiler area. A stapler is located between the compiler area and the sheet path exit for stapling compiled sheet sets. A plurality of transport nips is arrayed along the path loop.

A registration nip is disposed on the sheet path for decelerating sheets 1 through N from the input speed to a registration speed. The registration nip is also performs registering and accelerating selected sheets.

A first retime nip is disposed on the sheet path downstream of the registration nip. The first retime nip is for holding sheets 1 and 2 of the set at a predetermined speed and for accelerating sheets 1 and 2 of the set.

A second retime nip is disposed on the sheet path downstream of the first retime nip and before the compiler area. The second retime nip is for accelerating sheets 1 and 2 of the set to compiling speed.

A plurality of sensors is arrayed on the sheet path for sensing the position and speed of the sheets, wherein sheets 1 and 2 of the set are held at registration speed for a longer time than remaining sheets, so as to gain time for finishing.

In yet another aspect, a method for re-time sheet buffering is used in connection with a finisher for a digital printing system and a plurality of media sheets arranged in sets. Each set includes sheets 1, 2, 3 through N. The method comprises inputting the sheets at an input speed into a sheet path entrance of a sheet path. Space is provided for buffering by adding a path loop between the sheet path entrance and a sheet path exit. The sheets are transported along the path loop with a plurality of transport nips. The position and speed of the sheets is sensed with a plurality of sensors arrayed on the sheet path.

Sheets 1 through N are decelerated from the input speed to a registration speed with a registration nip on the sheet path. The sheets 1 through N are then registered with the registration nip. Selected sheets are accelerated to compiling speed with the registration nip.

Sheets 1 and 2 of each set are held at a predetermined speed with the registration nip and a first retime nip which is disposed on the sheet path downstream of the registration nip. Sheets 1 and 2 of each set are accelerated with the first retime nip.

Sheets 1 and 2 of each set are then accelerated to compiling speed with a second retime nip disposed on the sheet path downstream of the first retime nip. Sheets 1 and 2 of each set are held at registration speed for a longer time than remaining sheets, in order to gain time for finishing. Compiling the sheets of each set is carried out at a compiler speed. The set is then ejected.

In still another aspect, a method for re-time sheet buffering is used in connection with a finisher for a digital printing system and a plurality of media sheets arranged in sets. Each set includes sheets 1, 2, 3 through N. The method comprises inputting the sheets at an input speed into a sheet path entrance of a sheet path. Space is provided for buffering by adding a path loop between the sheet path entrance and a sheet path exit. The sheets are transported along the path loop with a plurality of transport nips. The position and speed of the sheets is sensed with a plurality of sensors arrayed on the sheet path.

Sheets 1 through N are decelerated from the input speed to a registration speed with a registration nip on the sheet path. An inboard driven roller of the registration nip is driven operatively with an inboard stepper motor. An outboard driven roller of the registration nip is driven operatively with an outboard stepper motor. The inboard driven roller is aligned collinear to the outboard driven roller. The inboard driven roller is not connected to the outboard driven roller. The sheets 1 through N are registered with the registration nip. Sheets 3 through N of the set are accelerated to compiling speed with the registration nip after registration.

Sheets 1 and 2 of each set are held at the registration speed with the registration nip and a first retime nip. The first retime nip is disposed on the sheet path downstream of the registration nip. Inboard and outboard driven rollers of the first retime nip are connected together on a common first drive shaft. The first drive shaft is driven operatively with a first stepper motor. Sheets 1 and 2 of each set are held at the registration speed for a longer time than sheets 3 through N of the set, so as to gain time for finishing. Sheets 1 and 2 of each set are accelerated with the first retime nip.

Sheets 1 and 2 of each set are accelerated to compiling speed with a second retime nip disposed on the sheet path downstream of the first retime nip. Inboard and outboard driven rollers of the second retime nip are connected together on a common second drive shaft. The second drive shaft is driven operatively with a second stepper motor. The sheets of each set are compiled a compiler speed. The set is then ejected.

These and other aspects, objectives, features, and advantages of the disclosed technologies will become apparent from the following detailed description of illustrative embodiments thereof, which is to be read in connection with the accompanying drawings.

DETAILED DESCRIPTION

Describing now in further detail these exemplary embodiments with reference to the Figures as described above, the re-time sheet buffering system is typically used in a select location or locations of the paper path or paths of various conventional media handling assemblies. Thus, only a portion of an exemplary media handling assembly path is illustrated herein. It should be noted that the drawings herein are not to scale.

As used herein, a "printer," "printing assembly" or "printing system" refers to one or more devices used to generate "printouts" or a print outputting function, which refers to the reproduction of information on "substrate media" or "media substrate" or "media sheet" for any purpose. A "printer," "printing assembly" or "printing system" as used herein encompasses any apparatus, such as a digital copier, bookmaking machine, facsimile machine, multi-function machine, etc. which performs a print outputting function.

A printer, printing assembly or printing system can use an "electrostatographic process" to generate printouts, which refers to forming and using electrostatic charged patterns to record and reproduce information, a "xerographic process", which refers to the use of a resinous powder on an electrically charged plate to record and reproduce information, or other suitable processes for generating printouts, such as an ink jet process, a liquid ink process, a solid ink process, and the like. Also, such a printing system can print and/or handle either monochrome or color image data.

As used herein, "media substrate" or "media sheet" refers to, for example, paper, transparencies, parchment, film, fabric, plastic, photo-finishing papers or other coated or non-coated substrates on which information can be reproduced, preferably in the form of a sheet or web. While specific reference herein is made to a sheet or paper, it should be understood that any media substrate in the form of a sheet amounts to a reasonable equivalent thereto. Also, the "leading edge" or "lead edge" (LE) of a media substrate refers to an edge of the sheet that is furthest downstream in the process direction.

As used herein, a "media handling assembly" refers to one or more devices used for handling and/or transporting media substrate, including feeding, printing, finishing, registration and transport systems.

As used herein, the terms "process" and "process direction" refer to a procedure of moving, transporting and/or handling a substrate media sheet. The process direction is a flow path the sheet moves in during the process.

Figure 1:
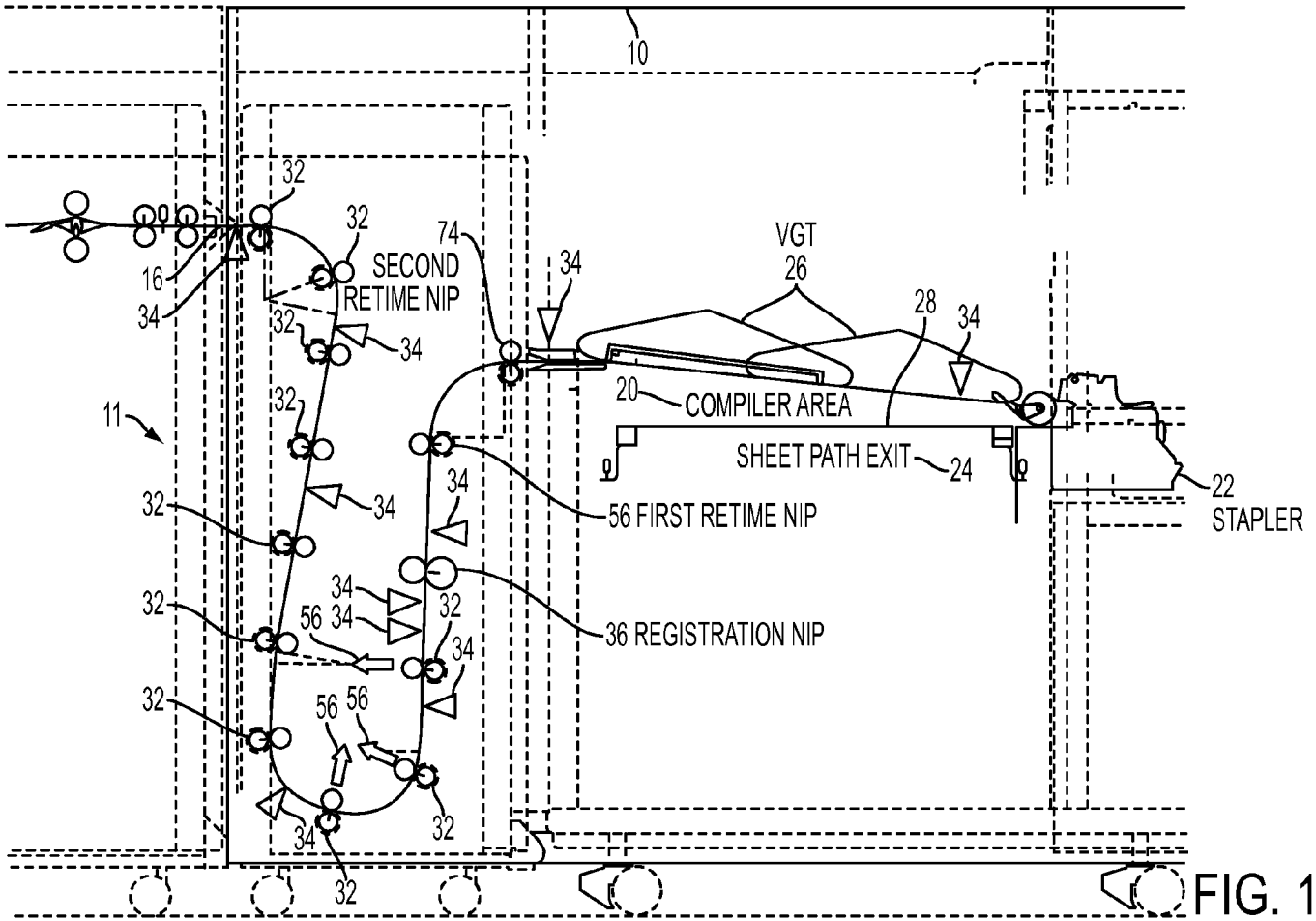
FIG. 1 is a schematic side elevational, sectional view of an exemplary production finisher showing a re-time sheet buffering system constructed in accordance with the invention.
Figure 2:
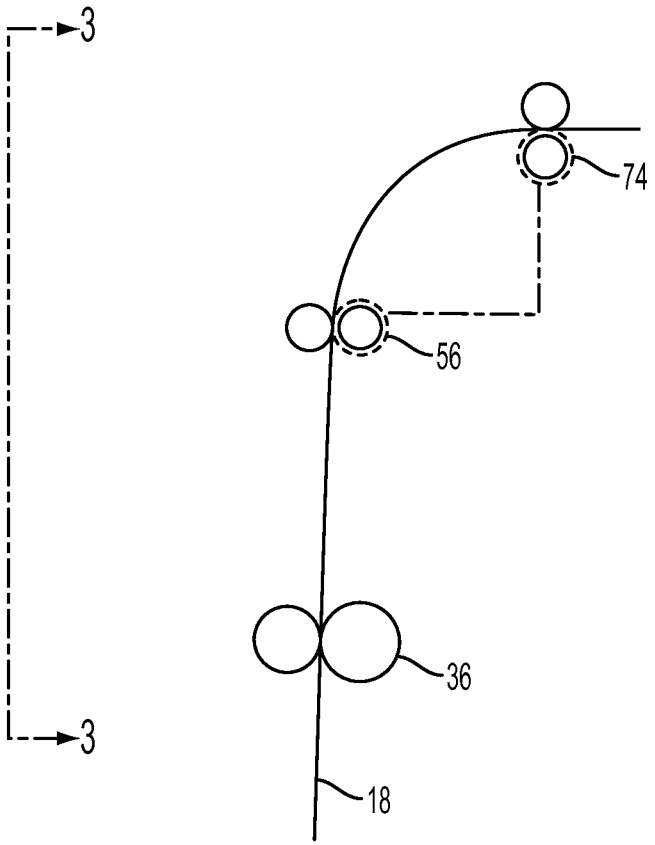
FIG. 2 is a schematic side elevational, sectional enlarged view of the re-time sheet buffering system of FIG. 1, showing the nips.
Figure 3:
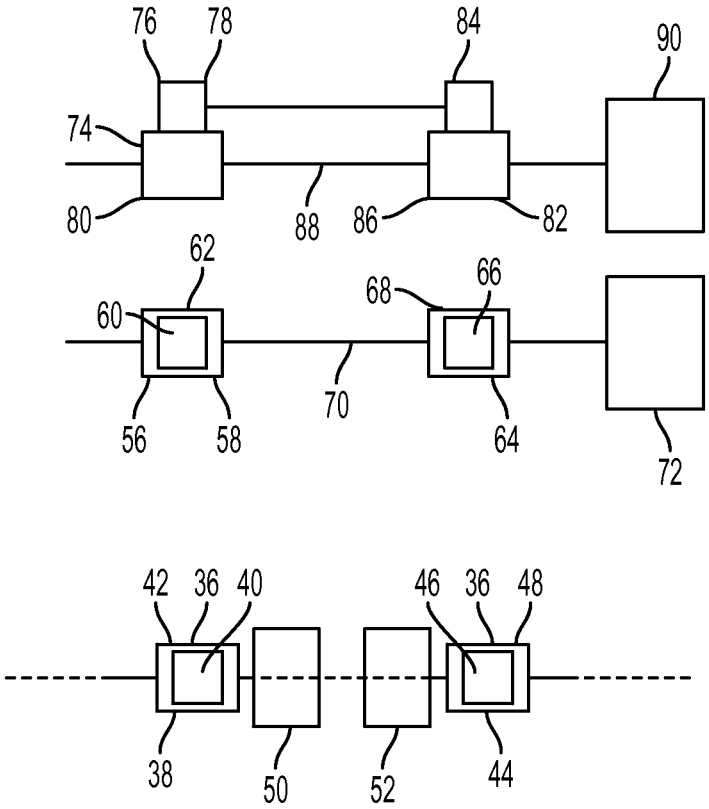
FIG. 3 is a schematic front elevational, sectional enlarged view of the re-time sheet buffering system of FIG. 1, taken along lines 3-3 of FIG. 2.

Referring to FIGS. 1, 2, and 3, the production finisher 10 uses a buffering system and method herein termed re-timing. The re-time sheet buffering system 11 is used in connection with a finisher for a digital printing system. The system uses a plurality of media sheets 12 arranged in sets, with each set 14 including sheets 1, 2, 3 through N. The finisher 10 typically has a media sheet path entrance 16, and a sheet path 18 along which the sheet 12 moves. A compiler sorts the sheets at a compiler area 20. A stapler 22 staples the sheets 12 in a set 14, and the set 14 is ejected at a sheet path exit 24. The embodiment described herein also has a vacuum gripper transport 26 or VGT adjacent the compiler, and a compiler shelf 28 to receive finished sets of media sheets. The VGT can be any conventional vacuum gripper transport. An example is found in U.S. Pat. No. 7,628,396, filed on Mar. 21, 20076, entitled, "High Speed Shingled Sheet Compiler," and assigned to the assignee hereof. The compiler area 20 may also include a fine registration system to be implemented just prior to the stapling process.

The process path or sheet path 18 will input the sheets 12 at an input speed at the sheet path entrance 16. The sheet path 18 has a path loop 30 between the sheet path entrance 16 and sheet path exit 24 so as to provide space for buffering. In the embodiment shown, the path loop 30 extends from the sheet path entrance 16 to the compiler area 20. Media sheets 12 enter the finisher sheet path entrance 16 at a nominal speed of about 1090 mm/s. The path loop 30 has a plurality of nips 32 and sensors 34 to maintain about 1090 mm/s through the path loop 30.

At some point in the path loop 30 a registration nip 36 is disposed on the sheet path 30 for decelerating sheets 1 through N from the input speed to a registration speed. The registration nip 36 performs skew correction, cross-process registration, and speed control. The lead edge (LE) of the sheet is sensed by two sensors to determine the skew of the sheet. Sensors can also be employed for edge detection. Reference is made to U.S. Pat. No. 7,422,210, which is incorporated herein in its entirety. The registration nips 36 are driven at slight differential speeds such that the sheet skew is corrected and eliminated. The registration nip 36 then accelerates selected sheets to compiling speed. Selected sheets are those sheets remaining after the first two or three sheets are re-timed. Starting with sheets 1 through N in a set, if sheets 1 and 2 are re-timed, then sheets 3 through N are the selected sheets. If sheets 1, 2, and 3 are re-timed, then sheets 4 through N are the selected sheets.

The registration nip 36 includes an inboard nip 38 having an idler roller 40 and a driven roller 42, and an outboard nip 44 having an idler roller 46 and a driven roller 48. The inboard 42 and outboard 48 driven nip rollers are on collinear rotation axes, but driven separately. The inboard driven roller 42 is not connected to the outboard driven roller 48. An inboard stepper motor 50 is operatively connected to the inboard driven roller 42. An outboard stepper motor 52 is operatively connected to the outboard driven roller 48.

Upstream of the registration nip 36 are several transport nips 32 having solenoids (arrows 54) that lift each idler nip roller from the respective driven nip roller, so that registration can proceed unhindered.

Downstream of the registration nip 36 on the sheet path 18 is a first retime nip 56. The first retime nip 56 holds sheets 1 and 2 of the set at a predetermined speed after registration, and accelerates sheets 1 and 2 of the set. Predetermined speed is any speed between registration speed and compiling speed. That is, predetermined speed is equal to or greater than registration speed and equal to or less than compiling speed. In the embodiment described herein, the predetermined speed will typically be registration speed. The first retime nip 56 includes an inboard nip 58 having an idler roller 60 and a driven roller 62, and an outboard nip 64 having an idler roller 66 and a driven roller 68. A first drive shaft 70 connects the inboard 62 and outboard 68 driven rollers. A first stepper motor 72 is operatively connected to the first drive shaft 70.

A second retime nip 74 is disposed on the sheet path 18 downstream of the first retime nip 56 and before the compiler area 20. The second retime nip 74 accelerates sheets 1 and 2 of the set to compiling speed. The second retime nip 74 includes an inboard nip 76 having an idler roller 78 and a driven roller 80, and an outboard nip 82 having an idler roller 84 and a driven roller 86. A second drive shaft 88 connects the inboard 80 and outboard 86 driven rollers. A second stepper motor 90 is operatively connected to the second drive shaft 88.

Thus, sheets 1 and 2 of the set are held at the predetermined speed for a longer time than remaining sheets, namely sheets 3 through N. This opens up space between the last sheet of a set and the first sheet of the next set to gain time for finishing.

Downstream of the registration nip 36 is a first retime nip 56 and further downstream a second retime nip 74, as shown in FIG. 2. These three nips are specially controlled by a controller (not shown) to allow synchronous acceleration, driving and deceleration of the re-timed sheets. After the second retime nip 74 the sheet path 18 is directed to the VGT 26 and the compiler and stapler 22. At registration, all sheets are slowed to about 650 mm/s to allow offsetting, whereupon registration is performed. In the case where buffering is unnecessary, all sheets will speed up to compiling speed of about 1380 mm/s before leaving the registration nips 36.

The sheets pass through both retime nips 56 & 74 at about 1380 mm/s and enter the VGT 26 at that speed. The VGT 26 uses pitched vacuum belts to acquire the LE of the sheet and to guide the LE directly into the compiler area 20 and into the stapler 22 throat for the final fine registration. The VGT pitch system must be carefully synchronized to the LE of the sheet for proper function, especially at 1380 mm/s. That speed is needed to handle sheets for the 157 prints per minute (PPM) production rate. The sheet sets are stapled and stacked, or sometimes only stacked. The sets are then ejected and exit the process path.

Figure 4:
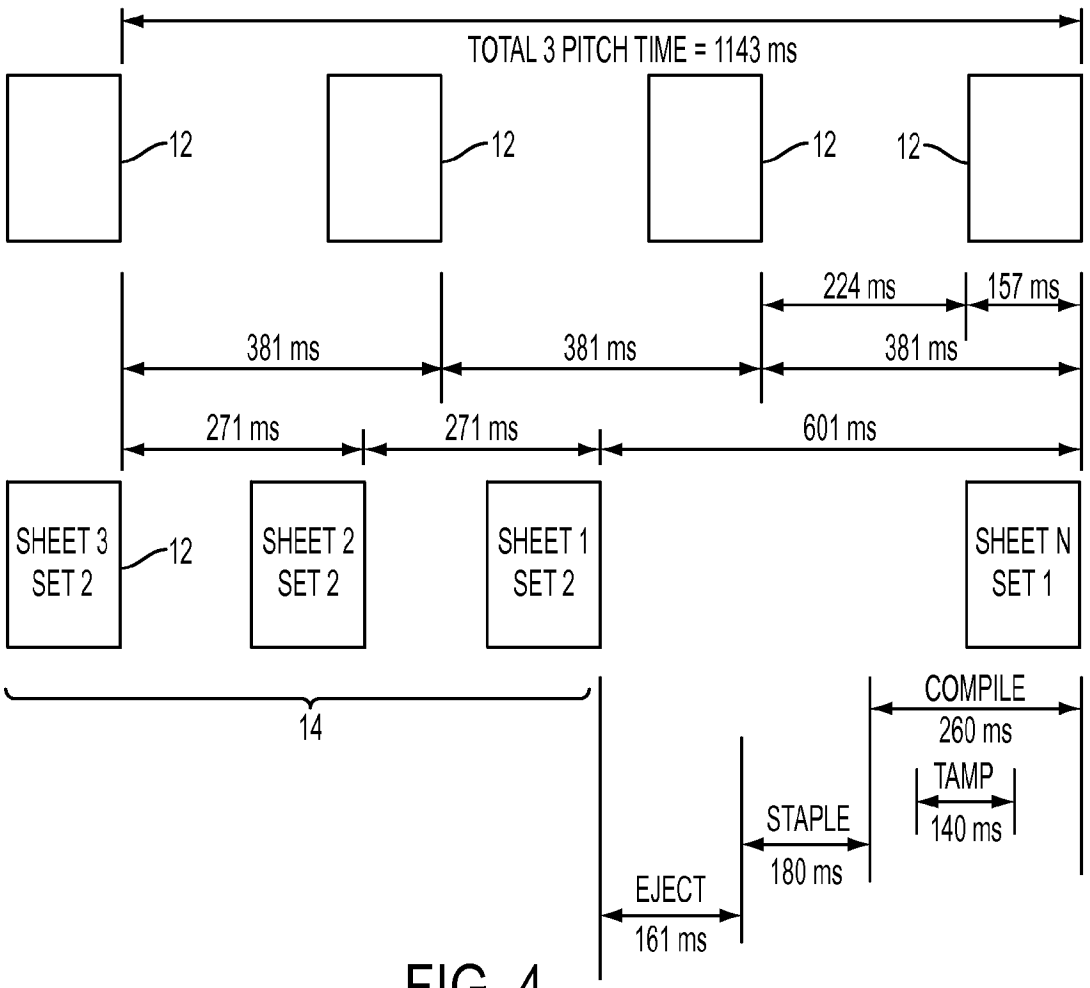
FIG. 4 is a schematic plan view of media sheets moving through the re-time sheet buffering system of FIG. 1.

In the case where buffering is necessary in order to gain time for compiling, stapling, and ejecting, the re-time sheet buffering system is employed. The pitch time of sheets is defined as the elapsed time from the LE of one sheet to the LE of the next sheet in line. At the 157 ppm speed, the pitch time of sheets is 0.381 seconds (381 ms), as shown in FIG. 4. The nominal compiling time requires about 0.260 seconds (260 ms). That leaves 0.121 seconds between sheets, which is insufficient for stapling and ejecting. Stapling requires about 0.180 seconds and ejecting requires another about 0.150 seconds. Stapling and ejecting thus require about 0.330 seconds. These functions must be completed before the next sheet (first sheet of the next set) enters the compiler. The first few sheets of a set, typically two sheets and optionally three sheets, are re-timed (buffered) such that they remain at the slow speed, about 650 mm/s, through registration and partly through the re-time transport. At some point the retime nips 56 & 74 will increase the sheet speed up to compiling speed of about 1380 mm/s at the VGT. These sheets are buffered or delayed in the paper path to free up some time, as the stapling and ejecting functions of the previous set are accomplished. Buffering provides about 0.110 seconds gain per sheet in the re-time transport. This limit is based upon an allowable minimum distance between a sheet trail edge and the next sheet lead edge. The limit is further determined by the VGT speed and belt pitch length. Buffering 2 sheets by re-timing gains 0.220 seconds. Adding this to the 0.121 seconds after compiling yields 0.341 seconds of time gained. Stapling and ejecting requires 0.330 seconds. Hence, these functions can be completed just before the next sheet enters the compiler.

The re-timing system is illustrated in FIG. 4. The first row represents four sheets 12 as they travel through the sheet path 18 at a steady rate. Assume these are sheets as they reach the compilers registration edge. The sheets are spaced apart with a pitch time of 0.381 seconds, or 381 ms, as shown in the first row of FIG. 4. When the last sheet of a set (sheet N) travels through the path, the next sheet (Sheet 1 of set 2) is processed differently than other sheets. It is specifically slowed down at the registration nip 36 and remains at this slow speed. The following sheet (Sheet 2 of set 2) is also slowed down when it gets to the registration nip 36 and remains at the slow speed. The pitch time is compressed to 0.271 seconds (271 ms) because of a limit with the VGT. With two sheets being re-timed (buffered), the time gained for stapling and ejecting is 0.220 seconds (220 ms). This is graphically represented in the second row of FIG. 4. Sheets 1 and 2 then increase in speed up to the compiler speed just prior to entering the VGT. Notice that in FIG. 4 the total pitch time between sets of 1.143 seconds (1143 ms) does not change. Therefore, the high production rate of 157 ppm is maintained, while the extra time needed for stapling and ejecting has been achieved by the re-time sheet buffering system.

It will be appreciated that variants of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A re-time sheet buffering system for use in connection with a finisher for a digital printing system and a plurality of media sheets arranged in sets, each set including sheets 1, 2, 3 through N, the re-time sheet buffer comprising:

a sheet path, having a sheet path entrance to input the sheets at an input speed, a sheet path exit to output the sheets, and a path loop between the sheet path entrance and sheet path exit so as to provide space for buffering;

a compiler area between the path loop and the sheet path exit;

a compiler for compiling sheet sets at a compiler speed in the compiler area;

a registration nip disposed on the sheet path for decelerating sheets 1 through N from the input speed to a registration speed, for registration, and for accelerating selected sheets;

a first retime nip disposed on the sheet path downstream of the registration nip for holding sheets 1 and 2 of the set at a predetermined speed after registration, and for accelerating sheets 1 and 2 of the set;

a second retime nip disposed on the sheet path downstream of the first retime nip and before the compiler area, for accelerating sheets 1 and 2 of the set to compiling speed; and a plurality of sensors arrayed on the sheet path for sensing the position and speed of the sheets;

wherein sheets 1 and 2 of the set are held at the predetermined speed for a longer time than remaining sheets, so as to gain time for finishing.

2. The re-time sheet buffering system of claim 1, wherein:

the first retime nip further comprises an inboard nip having an idler roller and a driven roller, an outboard nip having an idler roller and a driven roller, a first drive shaft connecting the inboard and outboard driven rollers, and a first stepper motor operatively connected to the first drive shaft;

the second retime nip further comprises an inboard nip having an idler roller and a driven roller, an outboard nip having an idler roller and a driven roller, a second drive shaft connecting the inboard and outboard driven rollers, and a second stepper motor operatively connected to the second drive shaft; and the registration nip further comprises an inboard nip having an idler roller and a driven roller, an outboard nip having an idler roller and a driven roller, an inboard stepper motor operatively connected to the inboard driven roller, an outboard stepper motor operatively connected to the outboard driven roller, the inboard and outboard driven rollers being collinear, the inboard driven roller being unconnected to the outboard driven roller.

3. The re-time sheet buffering system of claim 1, wherein:

the registration nip accelerates sheets 3 through N of the set to compiling speed after registration; and the first and second retime nips accelerate sheets 1 and 2 of the set to compiling speed after registration;

wherein sheets 1 and 2 of the set are held at registration speed for a longer time than sheets 3 through N of the set, so as to gain time for finishing.

4. The re-time sheet buffering system of claim 1, wherein:

the registration nip accelerates sheets 4 through N of the set to compiling speed after registration;

the first retime nip holds sheets 1, 2, and 3 of the set at registration speed and accelerates sheets 1, 2, and 3 of the set; and the second retime nip accelerates sheets 1, 2, and 3 of the set to compiling speed;

wherein sheets 1, 2, and 3 of the set are held at registration speed for a longer time than sheets 4 through N of the set, so as to gain time for finishing.

5. The re-time sheet buffering system of claim 1, further comprising:

the input speed being approximately 1090 mm/s;

the registration speed being approximately 650 mm/s;

the compiler speed being approximately 1380 mm/s; and the predetermined speed being between the registration speed and the compiler speed.

6. The re-time sheet buffering system of claim 1, further comprising:

a vacuum gripper transport adjacent the compiler area; and a stapler between the compiler area and the sheet path exit for stapling compiled sheet sets.

7. A re-time sheet buffering system for use in connection with a finisher for a digital printing system and a plurality of media sheets arranged in sets, each set including sheets 1, 2, 3 through N, the re-time sheet buffer comprising:

a sheet path, having a sheet path entrance to input the sheets at an input speed, a sheet path exit to output the sheets, and a path loop between the sheet path entrance and sheet path exit so as to provide space for buffering;

a compiler area between the path loop and the sheet path exit;

a compiler for compiling sheet sets at a compiler speed in the compiler area;

a transport apparatus adjacent the compiler area;

a stapler between the compiler area and the sheet path exit for stapling compiled sheet sets;

a plurality of transport nips arrayed along the path loop;

a registration nip disposed on the sheet path for decelerating sheets 1 through N from the input speed to a registration speed, for registration, and for accelerating selected sheets;

a first retime nip disposed on the sheet path downstream of the registration nip for holding sheets 1 and 2 of the set at a predetermined speed after registration, after registration and for accelerating sheets 1 and 2 of the set;

a second retime nip disposed on the sheet path downstream of the first retime nip and before the compiler area, for accelerating sheets 1 and 2 of the set to compiling speed; and a plurality of sensors arrayed on the sheet path for sensing the position and speed of the sheets;

wherein sheets 1 and 2 of the set are held at the predetermined speed for a longer time than remaining sheets, so as to gain time for finishing.

8. The re-time sheet buffering system of claim 7, wherein:

the first retime nip further comprises an inboard nip having an idler roller and a driven roller, an outboard nip having an idler roller and a driven roller, a first drive shaft connecting the inboard and outboard driven rollers, and a first stepper motor operatively connected to the first drive shaft;

the second retime nip further comprises an inboard nip having an idler roller and a driven roller, an outboard nip having an idler roller and a driven roller, a second drive shaft connecting the inboard and outboard driven rollers, and a second stepper motor operatively connected to the second drive shaft; and the registration nip further comprises an inboard nip having an idler roller and a driven roller, an outboard nip having an idler roller and a driven roller, an inboard stepper motor operatively connected to the inboard driven roller, an outboard stepper motor operatively connected to the outboard driven roller, the inboard and outboard driven rollers being collinear, the inboard driven roller being unconnected to the outboard driven roller.

9. The re-time sheet buffering system of claim 7, wherein:

the registration nip accelerates sheets 3 through N of the set to compiling speed after registration; and the first and second retime nips accelerate sheets 1 and 2 of the set to compiling speed after registration;

wherein sheets 1 and 2 of the set are held at registration speed for a longer time than sheets 3 through N of the set, so as to gain time for finishing.

10. The re-time sheet buffering system of claim 7, wherein:

the registration nip accelerates sheets 4 through N of the set to compiling speed after registration;

the first retime nip holds sheets 1, 2, and 3 of the set at registration speed and accelerates sheets 1, 2, and 3 of the set; and the second retime nip accelerates sheets 1, 2, and 3 of the set to compiling speed;

wherein sheets 1, 2, and 3 of the set are held at registration speed for a longer time than sheets 4 through N, so as to gain time for finishing.

11. The re-time sheet buffering system of claim 7, further comprising:

the input speed being approximately 1090 mm/s;

the registration speed being approximately 650 mm/s;

the compiler speed being approximately 1380 mm/s; and the predetermined speed being between the registration speed and the compiler speed.

12. The re-time sheet buffering system of claim 7, wherein the transport apparatus further comprises a vacuum gripper transport.

13. A method for re-time sheet buffering, for use in connection with a finisher for a digital printing system and a plurality of media sheets arranged in sets, each set including sheets 1, 2, 3 through N, the method comprising:

inputting the sheets at an input speed into a sheet path entrance of a sheet path;

providing space for buffering with a path loop between the sheet path entrance and a sheet path exit;

transporting the sheets along the path loop with a plurality of transport nips;

sensing the position and speed of the sheets with a plurality of sensors arrayed on the sheet path;

decelerating sheets 1 through N from the input speed to a registration speed with a registration nip on the sheet path;

registering the sheets 1 through N with the registration nip;

accelerating selected sheets to compiling speed with the registration nip;

holding sheets 1 and 2 of each set at a predetermined speed with the registration nip and a first retime nip disposed on the sheet path downstream of the registration nip;

accelerating sheets 1 and 2 of each set with the first retime nip;

accelerating sheets 1 and 2 of each set to compiling speed with a second retime nip disposed on the sheet path downstream of the first retime nip;

holding sheets 1 and 2 of each set at registration speed for a longer time than remaining sheets, so as to gain time for finishing;

compiling sheets of each set at a compiler speed; and ejecting the set.

14. The method of claim 13, further comprising:

accelerating sheets 3 through N of the set to compiling speed with the registration nip after registration;

accelerating sheets 1 and 2 of the set to compiling speed with the first and second retime nips after registration; and holding sheets 1 and 2 of each set at registration speed for a longer time than sheets 3 through N, so as to gain time for finishing.

15. The method of claim 13, further comprising:

accelerating sheets 4 through N of the set to compiling speed with the registration nip after registration;

holding sheets 1, 2, and 3 of the set at registration speed with the first retime nip accelerating sheets 1, 2, and 3 of the set with the first retime nip;

accelerating sheets 1, 2, and 3 of the set to compiling speed with the second retime nip; and holding sheets 1, 2, and 3 of the set at registration speed for a longer time than sheets 4 through N, so as to gain time for finishing.

16. The method of claim 13, further comprising:

connecting inboard and outboard driven rollers of the first retime nip together on a common first drive shaft;

driving the first drive shaft operatively with a first stepper motor;

connecting inboard and outboard driven rollers of the second retime nip together on a common second drive shaft;

driving the second drive shaft operatively with a second stepper motor;

driving an inboard driven roller of the registration nip operatively with an inboard stepper motor;

driving an outboard driven roller of the registration nip operatively with an outboard stepper motor; and aligning the inboard driven roller collinear to the outboard driven roller, the inboard driven roller being unconnected to the outboard driven roller.

17. The method of claim 13, further comprising transporting the sheets with a vacuum gripper transport before compiling.

18. The method of claim 13, further comprising stapling the set with a stapler after compiling.

19. A method for re-time sheet buffering, for use in connection with a finisher for a digital printing system and a plurality of media sheets arranged in sets, each set including sheets 1, 2, 3 through N, the method comprising:

inputting the sheets at an input speed into a sheet path entrance of a sheet path;

providing space for buffering with a path loop between the sheet path entrance and a sheet path exit;

transporting the sheets along the path loop with a plurality of transport nips;

sensing the position and speed of the sheets with a plurality of sensors arrayed on the sheet path;

decelerating sheets 1 through N from the input speed to a registration speed with a registration nip on the sheet path;

driving an inboard driven roller of the registration nip operatively with an inboard stepper motor;

driving an outboard driven roller of the registration nip operatively with an outboard stepper motor;

aligning the inboard driven roller collinear to the outboard driven roller, the inboard driven roller being unconnected to the outboard driven roller;

registering the sheets 1 through N with the registration nip;

accelerating sheets 3 through N of the set to compiling speed with the registration nip after registration;

holding sheets 1 and 2 of each set at the registration speed with the registration nip and a first retime nip disposed on the sheet path downstream of the registration nip;

connecting inboard and outboard driven rollers of the first retime nip together on a common first drive shaft;

driving the first drive shaft operatively with a first stepper motor;

holding sheets 1 and 2 of each set at the registration speed for a longer time than sheets 3 through N of the set, so as to gain time for finishing;

accelerating sheets 1 and 2 of each set with the first retime nip;

accelerating sheets 1 and 2 of each set to compiling speed with a second retime nip disposed on the sheet path downstream of the first retime nip;

connecting inboard and outboard driven rollers of the second retime nip together on a common second drive shaft;

driving the second drive shaft operatively with a second stepper motor;

compiling sheets of each set at a compiler speed; and ejecting the set.

20. The method of claim 19, further comprising:

transporting the sheets with a vacuum gripper transport before compiling; and stapling the set with a stapler after compiling.

* * * * *